US010034075B2

(12) United States Patent
Choi et al.

(10) Patent No.: US 10,034,075 B2
(45) Date of Patent: Jul. 24, 2018

(54) WIRELESS SOUND EQUIPMENT

(71) Applicant: LG ELECTRONICS INC., Seoul (KR)

(72) Inventors: Minhyuck Choi, Seoul (KR); Sangwoo Seo, Seoul (KR); Hyunsun Yoo, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 15/370,587

(22) Filed: Dec. 6, 2016

(65) Prior Publication Data

US 2017/0374445 A1 Dec. 28, 2017

(30) Foreign Application Priority Data

Jun. 22, 2016 (KR) ..... 10-2016-0078136

(51) Int. Cl.

| | |
|---|---|
| ***H04R 1/00*** | (2006.01) |
| ***H04R 1/10*** | (2006.01) |
| ***H04R 5/033*** | (2006.01) |
| *H04R 1/02* | (2006.01) |
| *H04R 1/28* | (2006.01) |

(52) U.S. Cl.

CPC ..... *H04R 1/1016* (2013.01); *H04R 1/105* (2013.01); *H04R 1/1033* (2013.01); *H04R 1/1041* (2013.01); *H04R 1/1066* (2013.01); *H04R 1/1075* (2013.01); *H04R 5/0335* (2013.01); *H04R 1/025* (2013.01); *H04R 1/1025* (2013.01); *H04R 1/288* (2013.01); *H04R 1/2811* (2013.01); *H04R 2201/105* (2013.01); *H04R 2201/107* (2013.01); *H04R 2420/07* (2013.01); *H04R 2460/07* (2013.01)

(58) Field of Classification Search

CPC .... H04R 1/1016; H04R 1/1041; H04R 1/105; H04R 1/1033; H04R 1/1066; H04R 1/1075; H04R 5/0335; H04R 1/025; H04R 1/1025; H04R 1/2811; H04R 1/288; H04R 2201/105; H04R 2201/107; H04R 2420/07; H04R 2460/07

USPC ..... 381/385

See application file for complete search history.

(56) References Cited

U.S. PATENT DOCUMENTS

2012/0148074 A1* 6/2012 Bastiaens ..... H04R 19/02 381/191

2013/0289986 A1 10/2013 Graylin (Continued)

FOREIGN PATENT DOCUMENTS

KR 10-1545147 B1 8/2015

KR 10-2016-0110302 A 10/2015

(Continued)

*Primary Examiner* — Sean H Nguyen

(74) *Attorney, Agent, or Firm* — Birch, Stewart, Kolasch & Birch, LLP

(57) ABSTRACT

A portable sound equipment including a main body including an upper case and a lower case; a speaker hole formed in a top surface of the upper case; a speaker module secured to an inner surface of the upper case and adjacent to the speaker hole; a wireless communication unit transceiving data wirelessly; and a main board mounted in an internal space of the lower case and separated from the speaker module and controlling the output of the speaker module based on a signal received by the wireless communication unit.

20 Claims, 7 Drawing Sheets

(56) References Cited

U.S. PATENT DOCUMENTS

| | | | | |
|---|---|---|---|---|
| 2013/0329903 | A1 | 12/2013 | Ting | |
| 2016/0037243 | A1* | 2/2016 | Lippert ..... | H04R 1/023<br>381/166 |

FOREIGN PATENT DOCUMENTS

| | | | |
|---|---|---|---|
| KR | 10-2015-0143277 | A | 12/2015 |
| KR | 10-2015-0144400 | A | 12/2015 |
| KR | 10-1609950 | B1 | 4/2016 |

* cited by examiner

WIRELESS SOUND EQUIPMENT

CROSS-REFERENCE TO THE RELATED APPLICATIONS

This application claims priority to Korean Patent Application No. 10-2016-0078136 filed on Jun. 22, 2016, in Korea, the entire contents of which are hereby incorporated by reference in their entirety.

BACKGROUND OF THE DISCLOSURE

Field of the Disclosure

Embodiments of the present disclosure relate to wireless sound equipment which receives a sound signal from a terminal and transmits a control signal for controlling the terminal by wireless communication with the terminal.

Background of the Disclosure

Sound equipment includes an audio device which can receive a sound signal from a terminal and transmit the audio information collected via a microphone to the terminal. Typically, the wire type portable sound equipment is commonly used and it is connected to an ear jack of a terminal to receive a sound signal. Recently, there are increasing demands for the wireless communication type wireless sound equipment in aspects of mobility and user convenience.

The wireless sound equipment having a design considering mobility is under development and examples of the wireless sound equipment having such the design include band-shaped headphone type wireless sound equipment, ear wearable type wireless sound equipment and ear inserting type wireless sound equipment. The band-shaped headphone type is worn on a user's head to make it easier for the user to carry.

Such conventional portable sound equipment can only tranceive data by wireless communication with a mobile terminal connected thereto and has a disadvantage of being unavailable without an external terminal. Suddenly, there are increasing demands for the portable sound equipment including a band wearable on a user's neck to improve portability.

SUMMARY OF THE DISCLOSURE

Accordingly, an object of the present invention is to address the above-noted and other problems and provide the portable sound equipment including a speaker module having an enclosure.

Embodiments of the present disclosure may provide a portable sound equipment comprising a main body; a speaker hole formed in a top surface of the main body; a speaker module mounted in the main body and adjacent to the speaker hole; a wireless communication unit transceiving data wirelessly; and a main board mounted in a bottom of an internal space defined by the main body and controlling the output of the speaker module based on a signal received by the wireless communication unit, wherein the speaker module is secured to an inner surface of an upper case of the main body and spaced apart from the main board.

According to the embodiments of the present disclosure, the portable sound equipment includes the speaker module having the enclosure and secures the quality of low pitched sound.

The speaker module in accordance with the present disclosure has the structure separated from the lower structure of the housing and blocking the vibration of the speaker module, not transmitted to the lower structure. Accordingly, the output deterioration can be prevented and the unpleasant feeling generated by the vibration transmitted to the user can be prevented advantageously.

Further scope of applicability of the present invention will become apparent from the detailed description given hereinafter. However, it should be understood that the detailed description and specific examples, while indicating preferred embodiments of the invention, are given by illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings, which are given by illustration only, and thus are not limitative of the present invention, and wherein.

DETAILED DESCRIPTION OF SPECIFIC EMBODIMENTS

Description will now be given in detail according to exemplary embodiments disclosed herein, with reference to the accompanying drawings. For the sake of brief description with reference to the drawings, the same or equivalent components may be provided with the same reference numbers, and description thereof will not be repeated. In general, a suffix such as "module" and "unit" may be used to refer to elements or components. Use of such a suffix herein is merely intended to facilitate description of the specification, and the suffix itself is not intended to give any special meaning or function. In the present disclosure, that which is well-known to one of ordinary skill in the relevant art has generally been omitted for the sake of brevity. The accompanying drawings are used to help easily understand various technical features and it should be understood that the embodiments presented herein are not limited by the accompanying drawings. As such, the present disclosure should be construed to extend to any alterations, equivalents and substitutes in addition to those which are particularly set out in the accompanying drawings.

Although the terms first, second, etc. may be used herein to describe various elements, these elements should not be limited by these terms. These terms are generally only used to distinguish one element from another. When an element is referred to as being "connected with" another element, the element can be directly connected with the other element or intervening elements may also be present. In contrast, when an element is referred to as being "directly connected with" another element, there are no intervening elements present.

A singular representation may include a plural representation unless it represents a definitely different meaning from the context. Terms such as "include" or "has" are used herein and should be understood that they are intended to indicate an existence of several components, functions or steps, disclosed in the specification, and it is also understood that greater or fewer components, functions, or steps may likewise be utilized.

Figure 1:
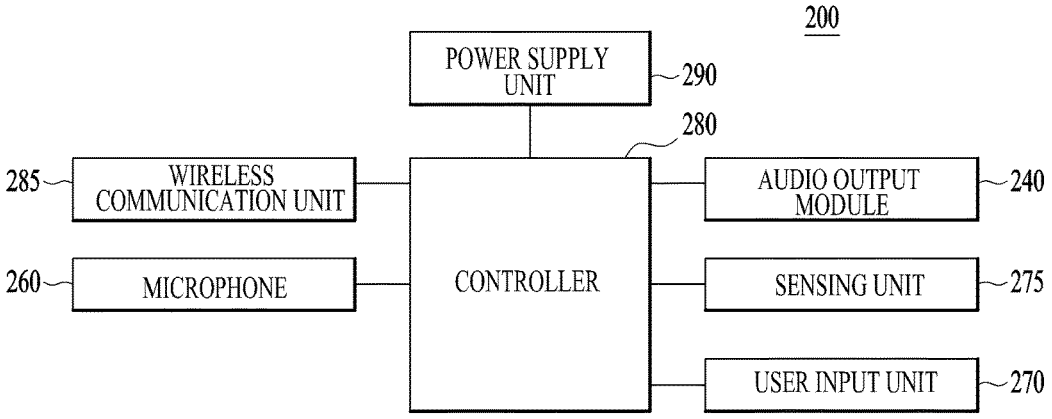
FIG. 1 is a block diagram illustrating a structure of portable sound equipment in accordance with an embodiment of the present disclosure.

FIG. 1 is a block diagram illustrating a structure of portable sound equipment in accordance with an embodiment of the present disclosure. The portable sound equipment 200 includes a controller 280, a wireless communication unit 285, a sound audio element 240, a sensing unit 275, a microphone 260, a user input unit 270 and a power supply unit 290.

Figure 2:
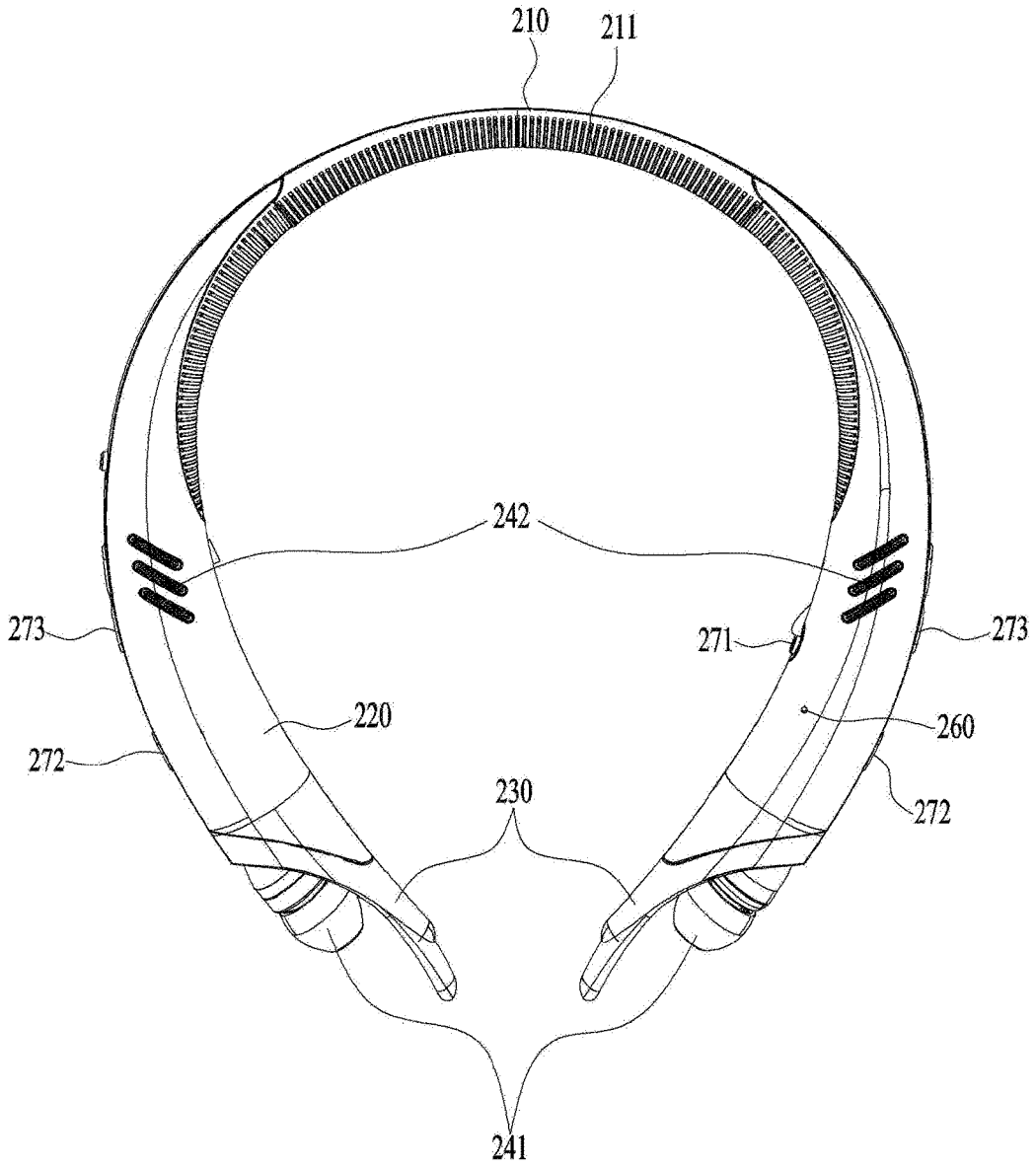
FIG. 2 is a perspective diagram illustrating one example of the portable sound equipment, viewed in one direction.

The sound audio element 240 is configured to output sounds according to a sound signal. As shown in FIG. 2, an earbud 241 is a device insertedly put on a user's ear to transmit sounds to the user. A speaker 242 is a device spaced apart from the user's ear, not insertedly put on the user's ear, to transmit sounds. Accordingly, the sound output from the speaker is louder than the sound output from the earbud 241.

The earbud 241 is detachable from the main body and insertedly put on the user's ear. Further, the speaker 242 is arranged in the main body. Specifically, the speaker may be arranged in the main body rather than in an elastic band 210, to be right under the user's ear.

The wireless communication unit 285 is implemented to receive data from another portable device such as an external terminal or a base station or transmit the command input via the user input unit to another portable device wirelessly. The wireless communication unit 285 uses short range wireless communication to transceiver signal with the portable device. Examples of such short range wireless communication support the short range communication, using one or more of Bluetooth™, RFIF (Radio Frequency Identification), IrDA (Infrared Data Association), UWB (Ultra Wideband), ZigBee, NFC (Near Field Communication), Wi-Fi (Wireless-Fidelity) and Wi-Fi Direct, Wireless USB (Wireless Universal Serial Bus).

When another portable electronic device capable of performing short range wireless communication is located in a wireless communicable range, the wireless communication unit 285 is automatically connected with the portable electronic device. Technical standards or communication methods for mobile communication are used in transceiving signals with base station.

For example, the wireless communication unit may transceiver a wireless signal with one or more of base station, external terminal and server on a mobile communication network built according to GSM (Global System for Mobile Communication), CDMA (Code Division Multi Access), CDMA2000 (Code Division Multi Access 2000), EV-DO (Enhanced Voice-Data Optimized or Enhanced Voice-Data Only), WCDMA (Wideband CDMA), HSDPA (High Speed Downlink Packet Access) and LTE-A (Long Term Evolution-Advanced). The wireless signal may include diverse types of data according to a voice call signal, a video telephone call signal or texture/multimedia message transmitting and receiving.

The controller 280 outputs sound by controlling the audio output module 240 based on the data received from the wireless communication unit 285, controls a portable electronic device according to the command input via the user input unit or transmits a signal to another portable electronic device connected with the portable electronic device.

The controller 280 controls the wireless communication unit 285 to automatically connect the portable sound equipment with the external terminal sensed by the short range communication unit and be implemented to connect the equipment with the sensed portable electronic device, when determining that the sensed portable electronic device is authenticated.

Further, the microphone 260 processes an external sound signal into electrical voice data. The processed voice data is transmitted to an external terminal or server via the wireless communication unit 285. Various noise removal algorithms can be realized in the microphone 260 to remove the noise generated while the external sound signal is input.

The sensing unit 275 is configured to recognize the state and circumstances of the portable sound equipment 200. The sensing unit 275 may include an illuminance sensor for sensing ambient illuminance, a touch sensor for sensing touch input, a gyro sensor for sensing the slope and location of the portable sound equipment 200 and an earbud switch for sensing whether the earbud 241 is located in an earbud holder 225.

The user input unit 270 is configured to allow the user to control the portable sound equipment 200. The user input unit 270 may include a call button 272, a volume button 273 for sound volume and a power button 271.

Figure 3:
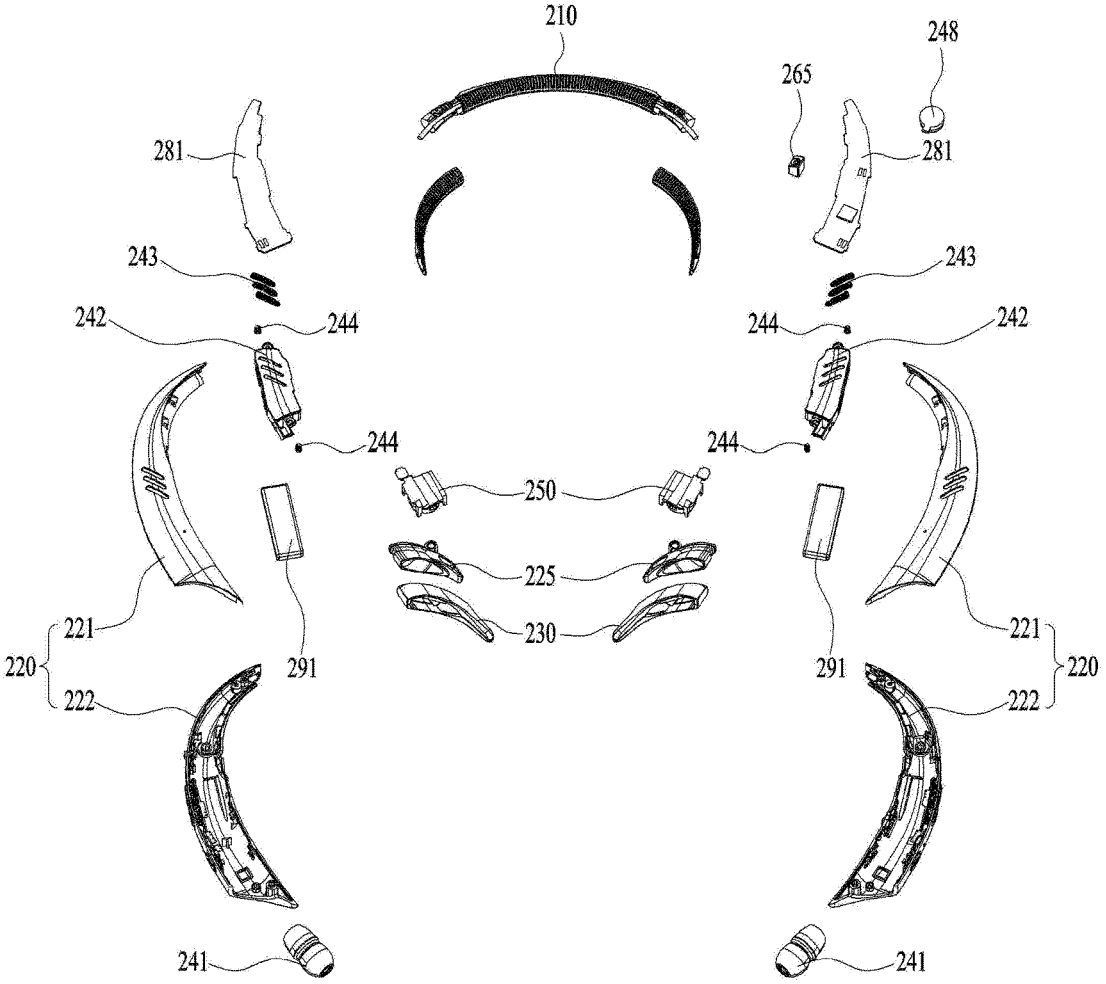
FIG. 3 is an exploded perspective diagram illustrating one example of the portable sound equipment.

FIG. 2 is a perspective diagram illustrating one example of the portable sound equipment 200, viewed in one direction. In addition, FIG. 3 is an exploded perspective diagram illustrating one example of the portable sound equipment 200. A main body of the portable sound equipment 200 includes an elastic band 210 and a housing 220. The main body may form a C-shaped curvature shown in FIG. 2.

The elastic band 210 is bendable in the C-shaped curvature and has certain elasticity. When an external force is applied to the elastic band 210, the curvature of the C-shaped line is varied in a preset range. When the external force applied to the elastic band 210 is removed, the elastic band 210 restitutes to the original shape. The housing 220 is coupled to each end of the elastic band 210 to be located in each end of the C-shaped curvature provided in the portable sound equipment 200. Diverse components are insertedly loaded in the housing 220 and an outer surface of the housing 210. The diverse components may include a printed circuit board 281, a speaker 243, a wireless communication unit 285, a battery 291, a rotary member 250 and the like.

The elastic band 210 and the housing 220 are connected with each other, with independent structures, respectively, or the elastic band 210 is made of a flexible material and the housing 220 is double-injection-molded, using a hard material to be integrally formed with the elastic band as one body.

The C-shaped portable sound equipment 200 is wearable on the user's neck so that the user can carry the portable sound equipment 200 with him or her. Especially, the portable sound equipment 200 in accordance with an embodiment of the present disclosure has a smaller internal diameter of the main body to be worn on the user's neck in close contact. When the user wears the portable sound equipment in close contact with the neck, the shaking caused in walking or running can be minimized and the disadvantage of the main body hitting the clavicle or separating from the neck can be prevented.

Every user has a different neck size. When the user having a large neck size wears the portable sound equipment, both ends of the main body are widened and the sense of stability the user feels during the wearing could deteriorate disadvantageously. Accordingly, the overall length of the main body can be adjusted, using replaceable wing tips 230 provided in both ends of the main body, so that each user having a different neck size can use the portable sound equipment conveniently.

As the area in contact with the user's neck is wider and wider, the portable sound equipment can be worn more and more stably by the frictional force. The frictional force is increased by forming unevenness 211 in an internal surface of the main body to contact with the user's neck.

Figure 4:
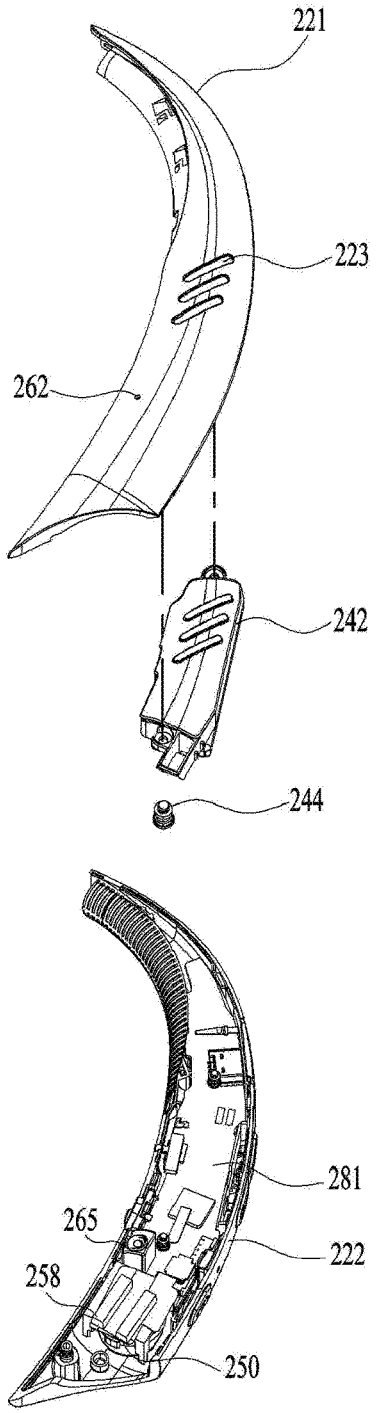
FIG. 4 is a diagram to describe a method of loading a speaker module in one example of the portable sound equipment.

A displacement sensor for sensing a curvature variation of the elastic band 210 may be provided. When the user wears the portable sound equipment, the displacement sensor can sense the widening of the ends of the portable sound equipment 200 as shown in FIG. 4. In this instance, the curvature of the elastic band 210 varies gently and it is sensed that the user tries to use the portable sound equipment 200, only to turn on the power of the portable sound equipment 200 or synchronize it with an external terminal.

The displacement sensor can consider the curvature after the curvature is varied drastically so as to determine more accurately whether the ends are widened while the user is carrying the portable sound equipment 200 or when the user tries to wear the portable sound equipment 200. When the curvature of the elastic band 210 changed to a first size is changed and fixed at a second size which is gentler than the curvature of the elastic band 210 of the portable sound equipment 200 rested in a cradle, it can be determined that the portable sound equipment 200 is worn one the user's neck.

Rather than the displacement sensor, a temperature sensor, an optical sensor or a hear rate sensor may be provided on a wearing surface which will contact with the user's neck when the user wears the portable sound equipment 200. If the temperature is in a range of human body temperatures, the brightness is getting dark, a hear rate is sensed, it is determined that the user wears the portable sound equipment and controls the power to be on or the wireless communication unit 285 to be activated so as to synchronize the portable sound equipment 200 with an external terminal.

As one alternative example, a switch which can be physically pressed can be provided. When the user wears the portable sound equipment 200, the projected switch is pressed and an ON-signal is generated. When the ON-state of the switch is maintained for a preset time period after that, the power of the portable sound equipment 200 can be switched on or synchronized with an external terminal. A plurality of sensors and switches can also be provided and the wearing of the portable sound equipment 200 can be determined more accurately based on the values gained from the sensors and switches.

Further, the housing 220 shown in FIG. 3 has an upper case 221 and a lower case 222 which are coupled to each other. Diverse components are loaded in the internal space defined by the upper and lower cases 221 and 222. The housing 220 may further include a side case additionally attached to a right or left portion or a top portion. The cases are made of a hard material to protect the internal components. For example, the cases are injection-molded of the synthetic resin such as stainless steel (STS), aluminum (Al), titanium (Ti) and the like.

Referring to FIG. 3, the diverse components loaded in the main body include a main board 281, a battery 291, a rotary module 250, an oscillator 248, a speaker module 242, a microphone 260 and the like. An earbud 241 is also loaded in an outer surface of the main body.

Various electronic components are mounted on the main board 281 as the controller 280. Further, the main board 281 controls the electronic components and processes the data collected from each of the components (for example, the voice data collected from the microphone, the user command sensed via the user input unit and the voice data received from the wireless communication unit).

The battery 291 is charged by the external power via a charging terminal and provides each of the components with the required electricity. The batteries 291 can be arranged in right and left portions of the portable sound equipment 200 for the right and left weight symmetry as shown in FIG. 3.

The earbud 241 has an output module mounted therein and insertedly worn on the user's ear. The earbud 241 may include an ear cap made of a flexible material to get fitted to the user's ear and transmits the sound to the user's ear directly. Because of that, the output of the earbud is lower than that of the speaker. The earbud 241 is detachably coupled to an external earbud holder 225 provided in an outer surface of the housing 220, not loaded in the main body, and connected to the main board 281 via an audio cable to output the received sound signal.

When the user is carrying the portable sound equipment 200, with the audio cable exposed outside, the audio cable is likely to get entangled in the hair or twisted inconveniently. Accordingly, a rotary module 250 may be further provided to store the audio cable in the housing 220. The rotary module 250 is connected with one end of the audio cable as a cylindrical member. The audio cable is wound around an outer circumferential surface of the rotary module 250 and the earbud 241 is pulled together with the audio cable to be seated on the earbud holder 225.

The user's voice and other sounds are input to the microphone 260 and the plurality of the microphones 260 may be provided in different portions, respectively, to receive input stereo sound.

An indicator may be further provided to transmit visual information to the user. The indicator may provide the user with different information, using diverse colors and flickering of light. For example, a red light is set to flicker during the charging and green light starts to flicker once the charging is complete. In case the wireless communication unit is connected with an external device, blue light is set to flicker.

The speaker module 242 functions as the sound audio element 240 transmitting sound to the user in a state of being spaced apart from the user's ear, different from the earbud. The output of the speaker module 242 has to be higher than that of the earbud and the sound output from the speaker module has to be spread farther that of the earbud. When the user wears the main body and puts the main body near the ear, the output of the speaker module is allowed to become lower and a speaker hole 223 is located in a top surface of the main body. A bottom surface of the main body contacts with the user's body when the user wears the portable sound equipment. If the speaker hole 223 is located in a bottom surface of the main body, the sound output from the speaker module could be not transmitted to the user's ear but spread around and then other people can hear the output sound.

The speaker module 242 provided in the related art smartphone is loaded on the main board 281 or arranged near the main board 281. However, the speaker provided in the portable sound equipment in accordance with an embodiment of the present disclosure is spaced apart from the main board 281 and it is configured as the speaker module 242 including a speaker housing 2421 in which the sound audio element 240 is loaded.

Figure 5:
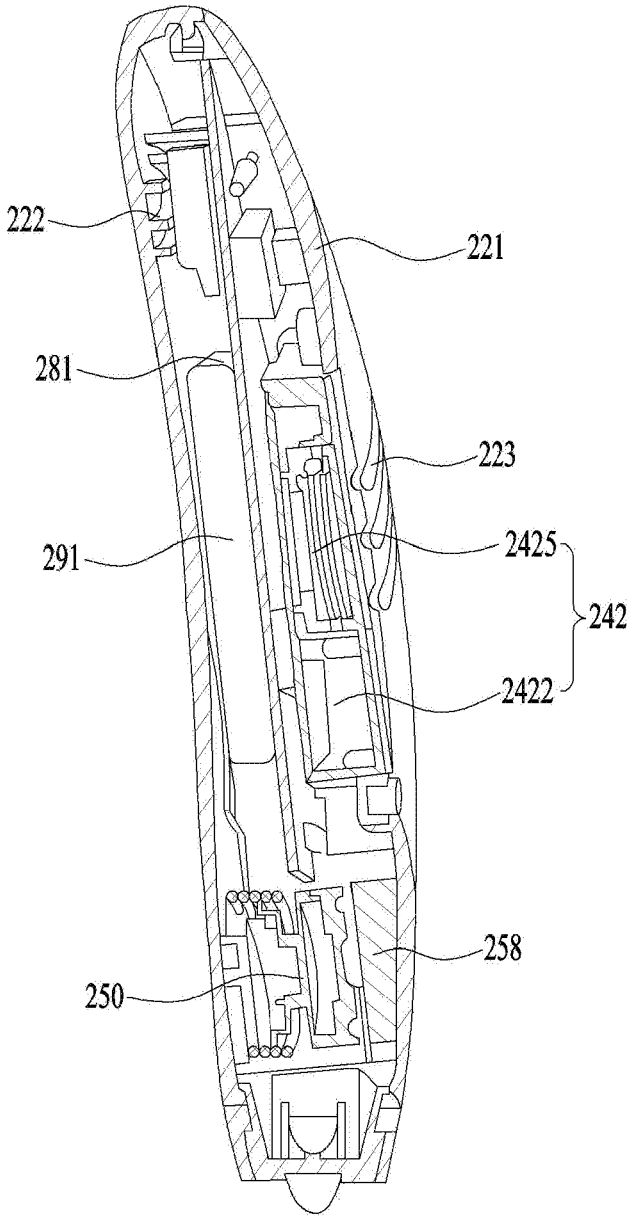
FIG. 5 is a sectional diagram illustrating the speaker module loaded in a housing.

FIG. 4 is a diagram to describe the loading method of the speaker module 242 provided in one example of the portable sound equipment, and FIG. 5 is a sectional diagram illustrating the speaker module 242 loaded in the housing 220. The housing 220 is configured of the upper case 221 and the lower case 222. The speaker module 242 is secured to a bottom surface of the upper case 221 by using a screw 244 to as to arrange a speaker hole of the speaker module 242 in a speaker hole 223 formed in the upper case 221. The main board 281 and the rotary module 250 are mounted in the lower case 222.

The speaker module 242 in accordance with an embodiment of the present disclosure is spaced apart from the lower case 222, not in contact with the main board 281 and the rotary module 250 mounted in the lower case 222. That is to prevent the vibration of the speaker module 242 from becoming delivered to the user's body directly. The speaker module 242 is vibrated when sound is output from the speaker module 242. If the vibration is delivered to the user's body, the output of the sound becomes lower and the user could feel uncomfortable. The lower structure and the upper structure have to be separated as far as possible.

Further, the microphone 260 loaded in the main board 281 collects sound via a mic-hole formed in the upper case 221 and a sound path has to be provided to transmit the sound taking in the mic-hole to the microphone 260 with no loss. In this instance, a mic-rubber 265 made of flexible rubber or silicon as the sound path may be arranged between the upper case 221 and the microphone 260.

The flexible material is arranged in the gap contacting with the upper and lower structures, only to prevent the vibration of the speaker module 242 from being transmitted to the lower structure via the upper case 221.

The rotary module 250 loaded in the lower case 222 generates and then noise vibration when rotating. An upper structure for controlling the vibration of the rotary module 250 is needed to reduce the noise. Accordingly, a gasket 258 made of a flexible material may be disposed between the upper case 221 and the rotary module 250. The gasket 258 functions to damp the vibration generated by the rotary module 250 rotating to retract or extract the audio cable.

The upper structure (configured of the upper case 221 and the speaker housing 2421) and the lower structure (configured of the lower case 222, the main board 281 and the rotary module 250) are arranged, spaced apart from each other, and partially in contact with each other with the mic-rubber 265 or gasket 258 made of the flexible material disposed in the contact portion, so that the vibration of the speaker module 242 cannot be transmitted to the lower structure.

Figure 6:
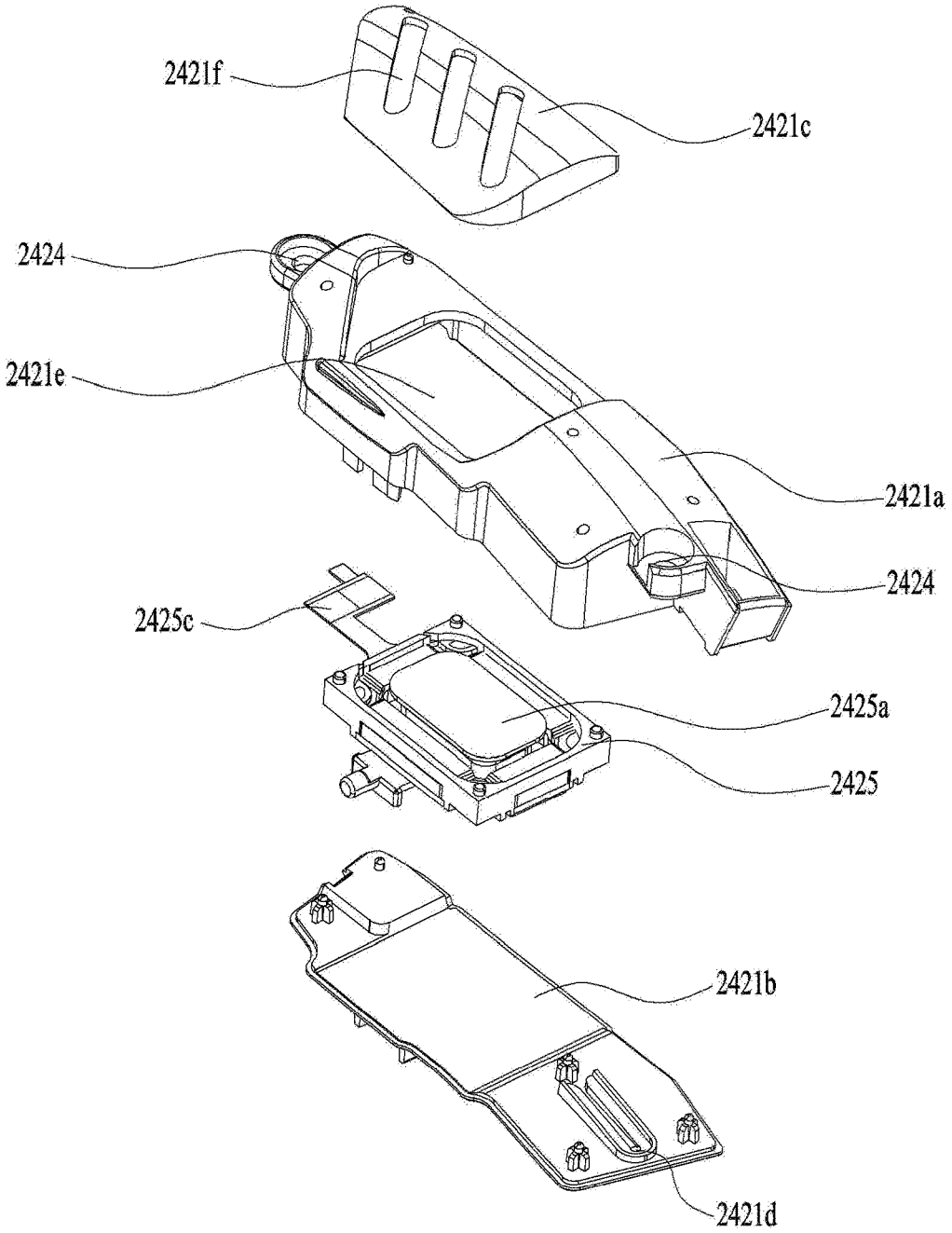
FIG. 6 is an exploded perspective diagram of the speaker module provided in one example of the portable sound equipment.
Figure 7:
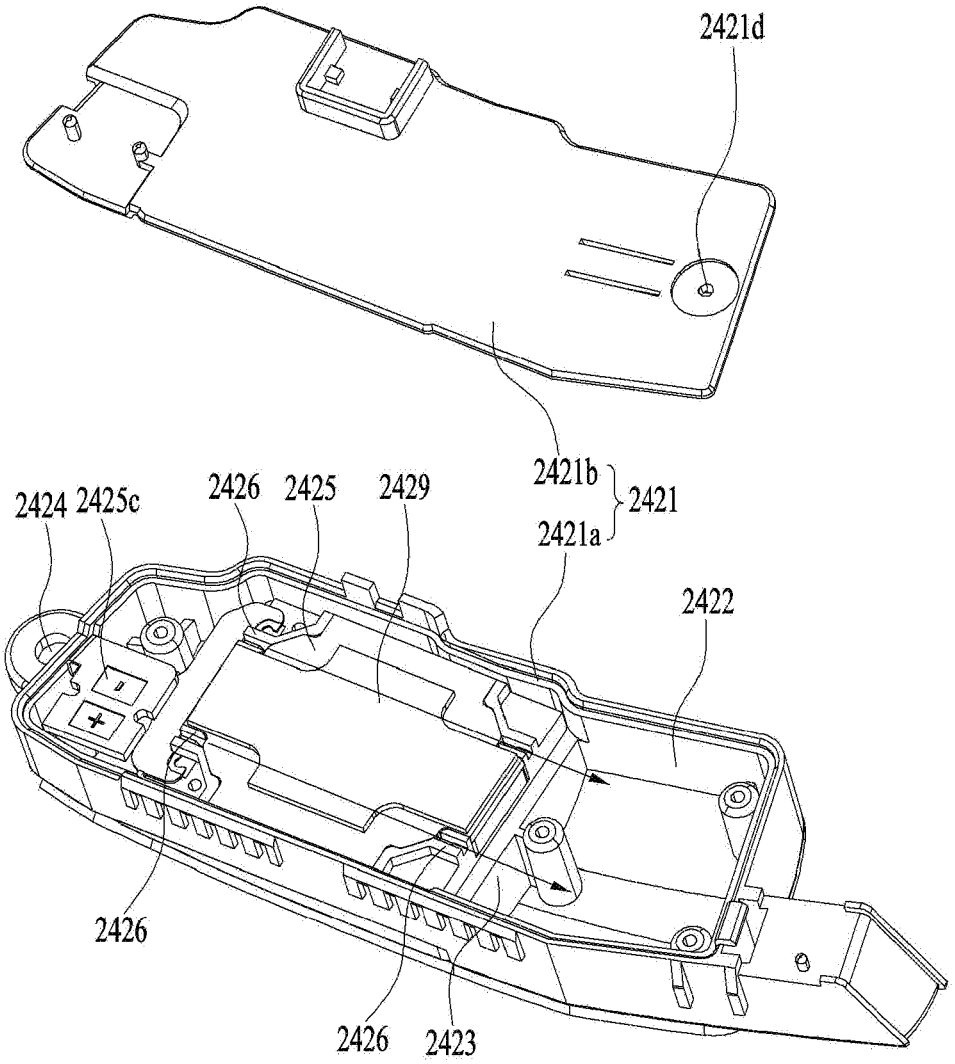
FIG. 7 is a diagram to describe the arrangement of an audio element and an enclosure in a speaker housing provided in one example of the portable sound equipment.

FIG. 6 is an exploded perspective diagram of the speaker module 242 provided in one example of the portable sound equipment, and FIG. 7 is a diagram to describe the arrangement of an audio element 2425 (see also FIG. 5) and an enclosure 2422 in the speaker housing 2421 provided in one example of the portable sound equipment.

The speaker module 242 in accordance with an embodiment of the present disclosure has the basic structure configured of the speaker housing 2421 and the audio element 2425 loaded in the speaker housing 2421. The speaker housing 2421 is formed of an injection mold and includes a first housing 2421*a* arranged in an upper portion and a second housing 242 lb arranged in a lower portion so as to load the audio element 2425 in the space defined thereby. The speaker housing 2421 has screw holes 2424 provided in both sides to be coupled to the upper case 221 by using a screw 244.

The audio element 2425 is loaded in a certain portion of the speaker housing 2421 and the enclosure 2422 is located in the other portion. The sound of the audio element 2425 resonates in the enclosure and the enclosure amplifies the sound. The speaker housing 2421 is divided into one portion and the other portion by a partition wall 2423. The audio element 2425 is inserted in the portion and an opening 2421*e* is formed in a top of the portion. Sound is output via the opening 2421*e* and a projection cover 2421*c* may cover the opening 2421*e*. The protection cover has a hole 2421*f* to project a diaphragm 2425*a* of the audio element 2425.

A top surface of the speaker housing 2421 is in close contact with a bottom surface of the upper case 221, so that the hole 2421*f* of the projection cover 2421*c* may be formed in a corresponding shape to the speaker hole 223. A net type grid (243, see FIG. 3) may be disposed between the projection cover 2421*c* and the speaker hole 223 of the speaker housing 2421 to make an internal space become invisible through the hole 2421*f* formed in the projection cover 2421*c*.

The audio element 2425 includes a top-open frame, coil, a permanent magnet arranged around the coil and a diaphragm 2425 covering the open top of the frame. The electric currents flowing in the coil and the magnetic field formed by the permanent magnet so as to form an electric field. The electric field vibrates the diaphragm 2425*a* and sound is generated. An electrode 2425*c* to the coil is connected to the main board 281 via a flexible board to supply the electric power. The electrode 2425*c* is arranged in the outer surface of the housing 2421.

When the diaphragm 2425*a* is vibrated, the volume of the space formed in the frame is varied. Accordingly, a second ventilation hole 2426 is formed to ventilate air into and from the frame. One or more second ventilation holes may be arranged in symmetry for balance. In case of a rectangular audio element 2425, four second ventilation holes 2426 may be arranged adjacent to corners of the rectangular audio element 2425.

The portion where the audio element 2425 is arranged and the enclosure 2422 are open to move the air exhausted via the second ventilation hole 2426 to the enclosure 2422. In other words, the partition wall 2423 is lower than the speaker housing 2421 to allow the portion to communicate with the other portion. As the air inside the enclosure 2422 flows along the movement of the diaphragm 2425*a*, a first ventilation hole 2421*d* can be further formed and external air communicates with the air inside the enclosure 2422 via the first ventilation hole 2421*d*.

The top surface of the lower structure faces the upper case 221 in contact and the first ventilation hole 2421*d* is formed in the bottom surface of the speaker housing 2421. The enclosure 2422 amplifies the volume of the low frequency sound and spread the sound farther. The function of the enclosure 2422 is more important in the speaker structure than in the earbud structure.

Referring to FIG. 7, a shock absorbing tape 2429 may be further provided in the bottom surface of the audio element 2425. The shock absorbing tape 2429 makes the bottom surface of the audio element 2425 spaced apart from the speaker housing 2421, not in contact, to provide certain space where the audio element 2425 can vibrate. The shock absorbing tape 2429 includes a flexible material and arranged in only a central portion of the housing 220 for the audio element 2425 to vibrate while getting seated in the housing 220.

Especially, the shock absorbing tape 2429 has a square shape with corners removed therefrom, in other words, a cross shape. If the shock absorbing tape 2429 is formed in the cross shape, the corners of the audio element 2425 may be spaced apart and free from the speaker housing 2421. The audio element 2425 may be stably seated in the speaker housing 2421, not tilted, because of a central portion of the cross-shaped shock absorbing tape 2425.

A terminal 2425*c* for transmitting a signal needed to drive the coil of the audio element 2425 is connected to the flexible board and exposed to a rear surface of the speaker housing 2421. The terminal 2425*c* may be connected to the main board 281 and a flexible terminal such as C-clip. As mentioned above, the portable sound equipment in accordance with the present disclosure may include the speaker module 242 having the enclosure and secure the quality of low pitched sound.

The speaker module 242 in accordance with the present disclosure has the structure separated from the lower structure of the housing and blocking the vibration of the speaker module 242, not transmitted to the lower structure. Accordingly, the output deterioration may be prevented and the unpleasant feeling generated by the vibration transmitted to the user may be also prevented advantageously.

As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds, are therefore intended to be embraced by the appended claims.

What is claimed is:

1. A portable sound equipment comprising:

a main body including an upper case and a lower case;

a speaker hole formed in a top surface of the upper case;

a speaker module secured to an inner surface of the upper case and adjacent to the speaker hole;

a wireless communication unit transceiving data wirelessly; and a main board mounted in an internal space of the lower case and separated from the speaker module and controlling the output of the speaker module based on a signal received by the wireless communication unit, wherein the speaker module comprises:

a speaker housing including a first housing and a second housing, the first housing having an opening formed in a top portion of the first housing, an audio element mounted in a first portion of the speaker housing and aligned with the opening;

an enclosure provided in a second portion of the speaker housing and amplifying a sound output by the audio element; and a first ventilation hole formed in the second housing, and wherein the opening is arranged adjacent to the speaker hole such that sound is output from the audio element through the speaker hole.

2. The portable sound equipment of claim 1, wherein the audio element comprises:

a diaphragm;

a coil arranged in a bottom of the diaphragm;

a permanent magnet arrange around the coil; and a frame accommodating the coil and a fixing an edge portion of the diaphragm to expose the diaphragm, and wherein the diaphragm is arranged in a top of the frame toward the opening.

3. The portable sound equipment of claim 2, wherein the frame comprises at least one second ventilation hole allowing an internal space of the audio element to communicate with the enclosure.

4. The portable sound equipment of claim 3, wherein the at least one second ventilation hole includes a plurality of second ventilation holes arranged in a bottom surface of the audio element in symmetry.

5. The portable sound equipment of claim 1, wherein the speaker housing further comprises a partition wall arranged between the audio element and the enclosure and having a height lower than the internal space of the speaker housing.

6. The portable sound equipment of claim 5, wherein the partition wall is extended from a top toward a bottom of the first housing, and wherein the partition wall is spaced apart from a bottom surface of the first housing.

7. The portable sound equipment of claim 1, further comprising:

a shock absorbing tape secured to a bottom surface of the audio element.

8. The portable sound equipment of claim 7, wherein the shock absorbing tape has cutting corner portions corresponding to corners of the audio element.

9. The portable sound equipment of claim 8, wherein the shock absorbing tape is formed in a cross shape.

10. The portable sound equipment of claim 1, further comprising:

a flexible board extended from the audio element to locate an end outside the speaker housing; and a terminal arranged in the end of the flexible board to be connected to the main board.

11. The portable sound equipment of claim 1, wherein the speaker module is secured to the upper case of the main body by using a screw.

12. The portable sound equipment of claim 1, further comprising:

a mic-hole formed in a top surface of the main body;

a microphone loaded in the main board;

a mic-rubber disposed between the microphone and the mic-hole; and a sound path connecting the mic-hole and an input hole of the microphone with each other.

13. The portable sound equipment of claim 1, further comprising:

a rotary module rotatably coupled to a lower case of the main body;

an audio cable having one end coupled to the rotary module and the other end extended outside;

an earbud connected to the other end of the audio cable to be insertedly worn on a user's ear; and a gasket disposed between a top of the rotary module and an upper case of the main body.

14. The portable sound equipment of claim 1, further comprising:

an elastic band for wearing the portable sound equipment around a neck portion of a user.

15. The portable sound equipment of claim 14, wherein the wireless communication unit receives audio data wirelessly from a mobile teiininal, and the main body controls the output of the speaker module to output the audio data received from the mobile terminal, and wherein the elastic band comprises unevenness for grasping the neck of the user while the user is wearing the portable sound equipment.

16. The portable sound equipment of claim 15, further comprising:

a call button provided on the upper case or the lower case for commanding the mobile terminal to perform a calling operation; and a volume button provided on the upper case or the lower case for controlling a volume of sound output by the speaker module.

17. The portable sound equipment of claim 14, further comprising:

at least one sensor for sensing the elastic band changing elasticity, wherein the main board turns on the portable sound equipment in response to the at least one sensor sensing the elastic band changing elasticity.

18. The portable sound equipment of claim 1, wherein the speaker module is arranged to output sound toward the upper case of the main body.

19. A portable sound equipment comprising:

a main body including an upper case and a lower case;

a speaker hole formed in a top surface of the upper case;

a speaker module secured to an inner surface of the upper case and adjacent to the speaker hole;

a wireless communication unit transceiving data wirelessly; and a main board mounted in an internal space of the lower case and separated from the speaker module and controlling the output of the speaker module based on a signal received by the wireless communication unit, wherein the speaker module comprises:

a speaker housing including a first housing and a second housing, the first housing having an opening formed in a top portion of the first housing;

an audio element mounted in the first housing and aligned with the opening;

an enclosure provided in another portion of the first housing and amplifying a sound output by the audio element;

a partition wall arranged between the audio element and the enclosure and having a height lower than the internal space of the speaker housing; and a first ventilation hole formed in the second housing.

20. A portable sound equipment comprising:

a main body including an upper case and a lower case;

a speaker hole formed in a top surface of the upper case;

a speaker module secured to an inner surface of the upper case and adjacent to the speaker hole;

a wireless communication unit transceiving data wirelessly; and a main board mounted in an internal space of the lower case and separated from the speaker module and controlling the output of the speaker module based on a signal received by the wireless communication unit, wherein the speaker module comprises:

a speaker housing including a first housing and a second housing, the first housing having an opening formed in a top portion of the first housing, an audio element mounted in a first portion of the speaker housing and aligned with the opening;

an enclosure provided in a second portion of the speaker housing and amplifying a sound output by the audio element; and a first ventilation hole formed in the second housing, wherein the audio element comprises:

a diaphragm;

a coil arranged in a bottom of the diaphragm;

a petmanent magnet arrange around the coil;

a frame accommodating the coil and a fixing an edge portion of the diaphragm to expose the diaphragm; and at least one second ventilation hole formed at the frame, the at least one second ventilation hole allowing an internal space of the audio element to communicate with the enclosure, and wherein the diaphragm is arranged in a top of the frame toward the opening.

* * * * *